US012156571B2

(12) United States Patent
Doraiswamy et al.

(10) Patent No.: US 12,156,571 B2
(45) Date of Patent: Dec. 3, 2024

(54) QUICK CONNECT ANCHORING BUCKLE

(71) Applicant: Koya Medical, Inc., Oakland, CA (US)

(72) Inventors: Anand Doraiswamy, Oakland, CA (US); Connor Meehan, Pleasant Hill, CA (US); Ian Kovacevich, Carlsbad, CA (US); Jarren Baldwin, Oakland, CA (US); John C. Pamplin, Charlotte, NC (US)

(73) Assignee: KOYA MEDICAL, INC., Oakland, CA (US)

( * ) Notice: Subject to any disclaimer, the term of this patent is extended or adjusted under 35 U.S.C. 154(b) by 0 days.

(21) Appl. No.: 18/158,688

(22) Filed: Jan. 24, 2023

(65) Prior Publication Data

US 2023/0270213 A1 Aug. 31, 2023

Related U.S. Application Data

(63) Continuation of application No. 17/381,520, filed on Jul. 21, 2021, now Pat. No. 11,583,038.

(60) Provisional application No. 63/055,800, filed on Jul. 23, 2020.

(51) Int. Cl.
*A44B 11/04* (2006.01)
*A44B 11/25* (2006.01)

(52) U.S. Cl.
CPC ..... *A44B 11/04* (2013.01); *A44B 11/2588* (2013.01); *A44D 2203/00* (2013.01)

(58) Field of Classification Search
CPC ..... A44B 11/04; A44B 11/2588; A44B 11/28; A44B 11/2557; A44B 11/2584; A44D 2203/00; A45C 13/1069
See application file for complete search history.

(56) References Cited

U.S. PATENT DOCUMENTS

| | | | |
|---|---|---|---|
| 4,018,064 | A | 4/1977 | Doslik |
| 4,527,402 | A | 7/1985 | Swallow et al. |
| 5,787,732 | A | 8/1998 | Perron et al. |
| 5,996,205 | A | 12/1999 | Mashiko et al. |
| 5,997,465 | A | 12/1999 | Savage et al. |
| 6,123,681 | A | 9/2000 | Brown, III |

(Continued)

FOREIGN PATENT DOCUMENTS

| | | | |
|---|---|---|---|
| CN | 101098670 | B | 7/2011 |
| CN | 103941909 | A | 7/2014 |

(Continued)

OTHER PUBLICATIONS

International Search Report and Written Opinion in Application No. PCT/US2021/042406, mailed on Oct. 25, 2021, in 12 pages.

*Primary Examiner* — Robert Sandy
*Assistant Examiner* — Louis A Mercado
(74) *Attorney, Agent, or Firm* — Knobbe, Martens, Olson & Bear, LLP

(57) ABSTRACT

Systems relating to a mechanical closure or locking device configured to allow for quick connect and disconnect. The systems can be used in conjunction with compression garments. The systems can include a buckle that couples to an anchor. The buckle and anchor can include complementary features that can mechanically interface to secure the buckle and anchor together. The buckle and anchor can include complementary magnetic elements to secure the buckle and anchor together. The buckle can be manipulated to tighten or loosen an adjustable strap.

19 Claims, 12 Drawing Sheets

(56) References Cited

U.S. PATENT DOCUMENTS

| | | | | |
|---|---|---|---|---|
| 6,190,344 | B1 | 2/2001 | Bobroff | |
| 6,509,094 | B1 | 1/2003 | Shah et al. | |
| 7,857,777 | B2 | 12/2010 | Larson et al. | |
| 7,868,221 | B2 | 1/2011 | Munch-Fals et al. | |
| 7,896,825 | B2 | 3/2011 | Atkinson et al. | |
| 8,359,716 | B2 * | 1/2013 | Fiedler | A44B 11/25 24/652 |
| 8,517,963 | B2 | 8/2013 | Larson et al. | |
| 8,523,794 | B2 | 9/2013 | Iker et al. | |
| 8,764,689 | B2 | 7/2014 | Toth | |
| 8,801,643 | B2 | 8/2014 | Deshpande et al. | |
| 9,027,408 | B2 | 5/2015 | Toth | |
| 9,161,878 | B1 | 10/2015 | Pamplin et al. | |
| 9,248,074 | B2 | 2/2016 | Toth | |
| 9,271,676 | B2 | 3/2016 | Alanen et al. | |
| 9,271,890 | B1 | 3/2016 | Pamplin et al. | |
| 9,326,911 | B2 | 5/2016 | Wyatt et al. | |
| 9,421,142 | B2 | 8/2016 | Malhi et al. | |
| 9,463,821 | B1 | 10/2016 | Critchley et al. | |
| 9,516,923 | B2 | 12/2016 | Capra et al. | |
| 9,555,935 | B2 | 1/2017 | Fiedler | |
| 9,572,410 | B2 | 2/2017 | Fiedler | |
| 9,677,581 | B2 | 6/2017 | Tucholke et al. | |
| 9,700,102 | B2 | 7/2017 | McCleary et al. | |
| 9,907,367 | B2 | 3/2018 | Paik et al. | |
| 9,936,772 | B2 | 4/2018 | Paik | |
| 10,071,012 | B2 | 9/2018 | Larson et al. | |
| 10,085,521 | B2 | 10/2018 | Chen et al. | |
| 10,098,422 | B2 | 10/2018 | Fiedler et al. | |
| 10,111,500 | B2 | 10/2018 | Lambert | |
| 10,143,270 | B2 | 12/2018 | Fiedler et al. | |
| 10,188,152 | B2 | 1/2019 | Stasey et al. | |
| 10,206,461 | B1 | 2/2019 | Swetish | |
| 10,285,902 | B2 | 5/2019 | Pamplin et al. | |
| 10,307,074 | B2 | 6/2019 | Ward | |
| 10,426,202 | B2 | 10/2019 | Wyatt et al. | |
| 10,441,491 | B2 | 10/2019 | Wyatt et al. | |
| 10,617,593 | B2 | 4/2020 | Wyatt et al. | |
| 10,668,305 | B2 | 6/2020 | Cheatham, III et al. | |
| 10,688,007 | B2 | 6/2020 | Wyatt et al. | |
| 10,743,621 | B2 | 8/2020 | Wyatt et al. | |
| 10,791,992 | B1 | 10/2020 | Desai et al. | |
| 10,893,968 | B2 | 1/2021 | Wetzel et al. | |
| 11,406,561 | B2 | 8/2022 | Pamplin et al. | |
| 11,471,368 | B2 | 10/2022 | Doraiswamy et al. | |
| 11,583,038 | B2 | 2/2023 | Doraiswamy et al. | |
| 11,672,729 | B2 | 6/2023 | Doraiswamy et al. | |
| 11,707,405 | B2 | 7/2023 | Pamplin et al. | |
| 11,903,895 | B2 | 2/2024 | Pamplin et al. | |
| 2002/0156401 | A1 | 10/2002 | Sherman et al. | |
| 2003/0005558 | A1 | 1/2003 | Wong | |
| 2003/0187366 | A1 | 10/2003 | Hashimshony | |
| 2005/0043657 | A1 | 2/2005 | Couvillon, Jr. | |
| 2008/0057526 | A1 | 3/2008 | Caduff et al. | |
| 2010/0056973 | A1 | 3/2010 | Farrow et al. | |
| 2010/0234779 | A1 | 9/2010 | Asvadi et al. | |
| 2010/0262135 | A1 | 10/2010 | Berube | |
| 2010/0312160 | A1 | 12/2010 | Creighton et al. | |
| 2011/0138583 | A1 | 6/2011 | Fielder | |
| 2011/0139835 | A1 | 6/2011 | Fikes | |
| 2011/0189444 | A1 | 8/2011 | Beers | |
| 2012/0016210 | A1 | 1/2012 | Kim et al. | |
| 2012/0065561 | A1 | 3/2012 | Ballas et al. | |
| 2012/0101417 | A1 | 4/2012 | Joseph | |
| 2012/0232447 | A1 | 9/2012 | Gordon et al. | |
| 2013/0030335 | A1 | 1/2013 | Norton | |
| 2013/0072837 | A1 | 3/2013 | Rousso et al. | |
| 2013/0267995 | A1 | 10/2013 | Voss et al. | |
| 2013/0303957 | A1 | 11/2013 | Bauerfeind | |
| 2014/0081187 | A1 | 3/2014 | Wyatt et al. | |
| 2014/0277103 | A1 | 9/2014 | Esposito | |
| 2015/0025426 | A1 | 1/2015 | Larson et al. | |
| 2015/0065930 | A1 | 3/2015 | Wyatt et al. | |
| 2015/0073318 | A1 | 3/2015 | Holschuh et al. | |
| 2015/0073319 | A1 | 3/2015 | Holschuh et al. | |
| 2016/0022528 | A1 | 1/2016 | Wyatt et al. | |
| 2016/0074234 | A1 | 3/2016 | Abichandani et al. | |
| 2016/0120733 | A1 | 5/2016 | Ishikawa et al. | |
| 2016/0193100 | A1 | 7/2016 | Toth | |
| 2016/0220808 | A1 | 8/2016 | Hyde et al. | |
| 2016/0331620 | A1 | 11/2016 | Kazanchyan et al. | |
| 2016/0374886 | A1 | 12/2016 | Wyatt et al. | |
| 2017/0196347 | A1 | 7/2017 | Sawhney et al. | |
| 2017/0246073 | A1 | 8/2017 | Van-De-Velde | |
| 2017/0252252 | A1 | 9/2017 | Wyatt et al. | |
| 2017/0304136 | A1 | 10/2017 | Holschuh et al. | |
| 2017/0304139 | A1 | 10/2017 | Ross | |
| 2017/0312161 | A1 | 11/2017 | Johnson et al. | |
| 2018/0055009 | A1 | 3/2018 | Wyatt et al. | |
| 2018/0125173 | A1 | 5/2018 | Lambert | |
| 2018/0177677 | A1 | 6/2018 | Pamplin et al. | |
| 2018/0192745 | A1 | 7/2018 | McDaniel | |
| 2018/0214616 | A1 | 8/2018 | Muschalek et al. | |
| 2018/0242655 | A1 | 8/2018 | Holschuh et al. | |
| 2018/0368533 | A1 | 12/2018 | Chan | |
| 2019/0274372 | A1 | 9/2019 | Rizzo et al. | |
| 2020/0000676 | A1 | 1/2020 | Pamplin et al. | |
| 2020/0000677 | A1 | 1/2020 | Pamplin et al. | |
| 2020/0154804 | A1 | 5/2020 | Huang | |
| 2020/0297569 | A1 | 9/2020 | Angelo et al. | |
| 2021/0386614 | A1 | 12/2021 | Doraiswamy et al. | |
| 2022/0022606 | A1 | 1/2022 | Doraiswamy et al. | |
| 2022/0409123 | A1 | 12/2022 | Baldwin et al. | |
| 2022/0409437 | A1 | 12/2022 | Pamplin et al. | |
| 2023/0066937 | A1 | 3/2023 | Pamplin et al. | |
| 2023/0117892 | A1 | 4/2023 | Doraiswamy et al. | |
| 2023/0248579 | A1 | 8/2023 | Evans et al. | |

FOREIGN PATENT DOCUMENTS

| | | |
|---|---|---|
| CN | 105082129 A | 11/2015 |
| CN | 105804960 | 7/2016 |
| FR | 3123202 | 12/2022 |
| KR | 10-1569850 | 11/2015 |
| WO | WO 2013/025481 | 2/2013 |
| WO | WO 2013/149985 | 10/2013 |
| WO | WO 2014/172248 | 10/2014 |
| WO | WO 2016/048827 | 3/2016 |
| WO | WO 2016/077150 | 5/2016 |
| WO | WO 2017/027145 | 2/2017 |
| WO | WO 2018/013188 | 1/2018 |
| WO | WO 2018/150372 | 8/2018 |
| WO | WO 2020/144437 | 7/2020 |
| WO | WO 2021/150619 | 7/2021 |
| WO | WO 2021/252770 | 12/2021 |
| WO | WO 2022/020370 | 1/2022 |
| WO | WO 2022/272285 | 12/2022 |
| WO | WO 2022/272287 | 12/2022 |
| WO | WO 2023/154707 | 8/2023 |

* cited by examiner

QUICK CONNECT ANCHORING BUCKLE

INCORPORATION BY REFERENCE

This application is a continuation of U.S. application Ser. No. 17/381,520, filed Jul. 21, 2021, now U.S. Pat. No. 11,583,083, which claims the priority benefit of U.S. Provisional Application No. 63/055,800, filed Jul. 23, 2020, each of which are hereby incorporated by reference in their entireties herein and made a part of this specification. Any and all applications for which a foreign or domestic priority claim is identified in the Application Data Sheet as filed with the present application are hereby incorporated by reference under 37 CFR 1.57.

BACKGROUND

Field of the Invention

A system relates in some aspects to a mechanical closure or locking device configured to allow quick connect and disconnect. The system can also advantageously allow the user to control and adjust the tension of an attached strap.

SUMMARY

Conventional buckle systems for tightening and untightening straps can be inconvenient, especially if the straps become tangled, and undue force is required. Quick-connect systems can be highly advantageous, especially those that do not require mechanical locking mechanisms, and also advantageously allow the user to control and adjust the tension of an attached strap.

In some embodiments, disclosed herein is a quick connect system, comprising: an anchor comprising a housing and a base, the housing comprising at least one magnetic element associated with the housing, and a coupling feature on the housing; and a buckle comprising a frame, a crossbar spanning an interior portion of the frame, and at least one magnetic element associated with an end of the frame configured to reversibly connect to the coupling feature solely via magnetic attraction force of the one magnetic element associated with the housing.

In some embodiments, the coupling feature comprises a groove.

In some embodiments, the groove comprises open ends.

In some embodiments, the groove extends generally longitudinally with respect to a long axis of the housing.

In some embodiments, the base comprises laterally extending portions.

In some embodiments, the base comprises mating features configured to connect the anchor to another device.

In some embodiments, the at least one magnetic element associated with an end of the frame spans two spaced-apart ends of the frame.

In some embodiments, the system further comprises a strap configured to associate with the buckle.

In some embodiments, the strap is wrapped around the crossbar of the buckle, and wherein pulling the strap in a first direction causes tensioning of the strap.

In some embodiments, a method can comprise providing an anchor comprising a housing and a base, the housing comprising at least one magnetic element associated with the housing, and a coupling feature on the housing; providing a buckle comprising a frame, a crossbar spanning an interior portion of the frame, and at least one magnetic element associated with an end of the frame, wherein a strap is operatively associated with the buckle and forms a loop around the crossbar; and/or coupling the anchor to the buckle by magnetic attraction such that the at least one magnetic element of the buckle rests against the coupling feature on the anchor.

In some embodiments, the coupling feature comprises a groove.

In some embodiments, the method further comprises pulling the at least one magnetic element away of the buckle in a direction away from the anchor, thus disconnecting the buckle and the strap from the anchor.

In some embodiments, the base of the anchor is coupled to another device.

In some embodiments, the other device comprises a compression device wrapped around a body part of a patient.

In some embodiments, the method further comprises tightening the strap by pulling the strap away from the anchor while the buckle is coupled to the anchor.

In some embodiments, the method further comprises loosening the strap by rotating the buckle with respect to the anchor while the buckle is coupled to the anchor.

In some embodiments, a system can comprise, not comprise, or consist essentially of any number of features of the disclosure.

In some embodiments, a method can comprise, not comprise, or consist essentially of any number of features of the disclosure.

DETAILED DESCRIPTION

In some embodiments, a system includes a mechanical closure or locking device configured to allow quick connect and disconnect. The system can also advantageously allow the user to control and adjust the tension of an attached strap. Features from different embodiments can be combined together.

Figure 1A:
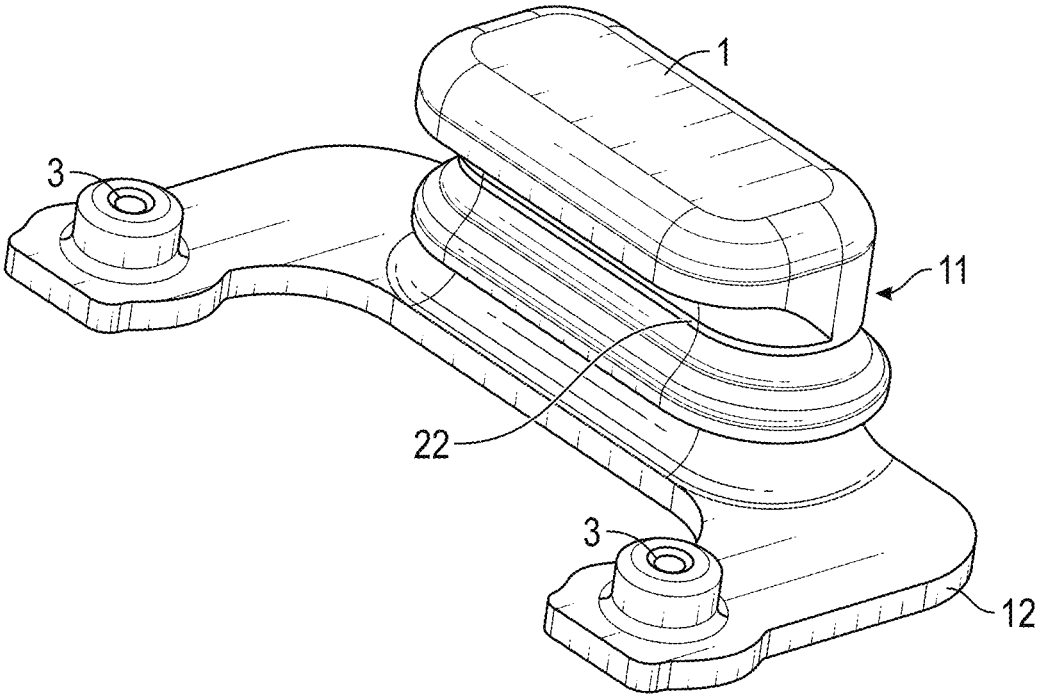
FIGS. 1A and 1B illustrate an embodiment of an anchor that can include a housing including one or more magnetic elements configured to interface with a corresponding mating component or system.
Figure 1B:
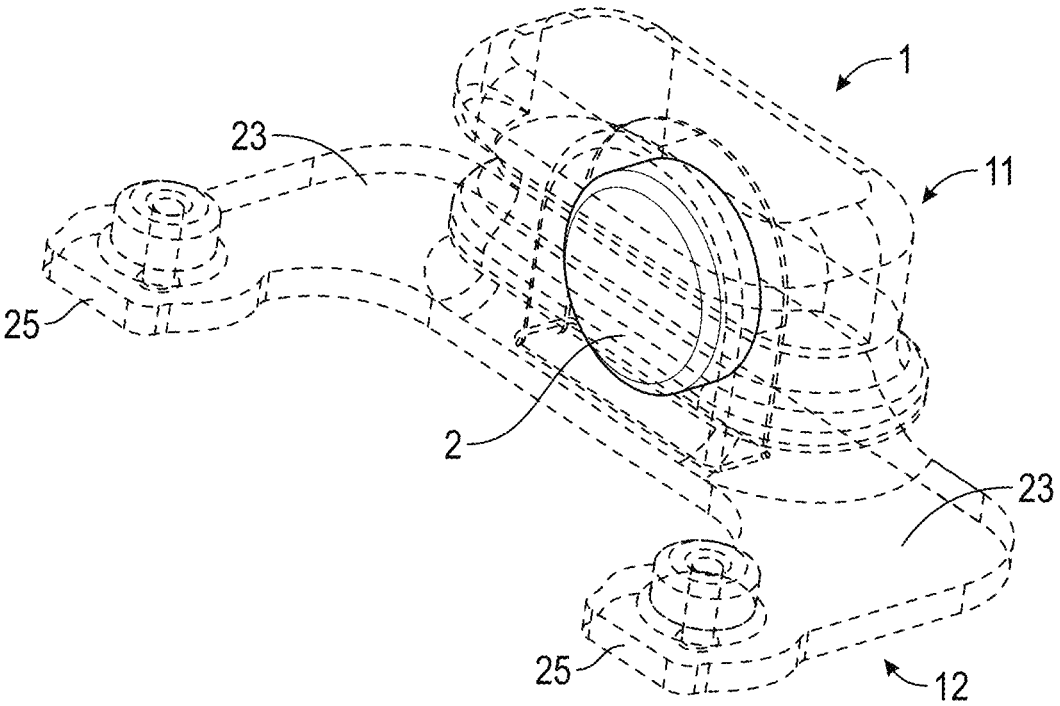

The system can include, in some embodiments, an anchor 1 and a buckle 4. As illustrated in FIGS. 1A and 1B, the anchor 1 can include a structure that is rigid in some embodiments, including a housing 11 including one or more magnetic elements 2 configured to interface with a corresponding mating component or system. In some embodiments, the anchor 1 can include a housing 11 and a base 12, including mating elements 3.

In some embodiments, the housing 11 of the anchor 1 can include a geometric mating feature such as one or more of a groove, slot, or channel 22. The feature 22 can in some cases run substantially horizontally, although oblique or vertical channels are also possible in other embodiments. The feature 22 can run substantially parallel to the longitudinal axis of the housing 11 in some cases. The anchor 1 can include mating elements 3, which can be complementary snap mechanisms, threaded apertures, or other reversible locking structures, etc. that can attach to any device or devices requiring a quick-connect adjustable strap, such as wearable and other medical devices (e.g., upper or lower extremity bands, compression devices, compression garments, socks, cuffs, or the like), athletic equipment, carrying equipment such as backpacks, waistpacks, industrial or transportation equipment such as tie-downs, and a variety of other applications. In some variants, the housing 11 can extend away from the base, which can space the feature 22 away from the base 12. The housing 11 can have a variety of peripheries, which can include polygonal (e.g., rectangular, square, etc.), circular, oval, irregular, and/or others. In some variants, the housing 11 can have a rectangular periphery with rounded corners.

One, two, three or more magnetic elements 2 can be operably attached to the anchor 1, such as operably attached to the housing 11, such as attached to a wall of the housing 11, or partially or completely surrounded by the housing 11 as illustrated schematically in FIG. 1B. The magnetic element 2 can include a single magnet, or a plurality of magnets, such as, for example, 2, 3, 4, 5, 6, 7, 8, 9, 10, or more magnets, or a magnet array. In some variants, the housing 11 can include a cavity therein to receive one or more magnetic element(s) 2 therein.

In some embodiments, magnets can include any magnetic materials, and could be any of, or any combination of the following: electromagnets; rare earth magnets; neodymium (magnet strength can be based on type or size of magnet); ferrous materials (including but not limited to a true iron ferrite core), and nickel and/or cobalt. A rare earth magnet could include a magnet including any number of a collection of seventeen chemical elements in the periodic table, including scandium, yttrium, the fifteen lanthanoids, and any combination thereof. The fifteen lanthanoids include lanthanum, cerium, praseodymium, neodymium, promethium, samarium, europium, gadolinium, terbium, dysprosium, holmium, erbium, thulium, ytterbium, and lutetium. In some embodiments, a magnet may be a permanent magnet made of ferromagnetic materials, or made from compositions including rare-earth materials, such as neodymium-iron boron-43 (NdFeB-43), neodymium-iron boron-45 (NdFeB-45), neodymium-iron boron-48 (NdFeB-48) or neodymium-iron boron-50 (NdFeB-50), for example.

Still referring to FIGS. 1A-1B, the base 12 can include laterally extending portions 23 and mating elements 3 on the laterally extending portions 23 or on the ends such as forward (or rearward) extensions 25, as shown.

Figure 2:
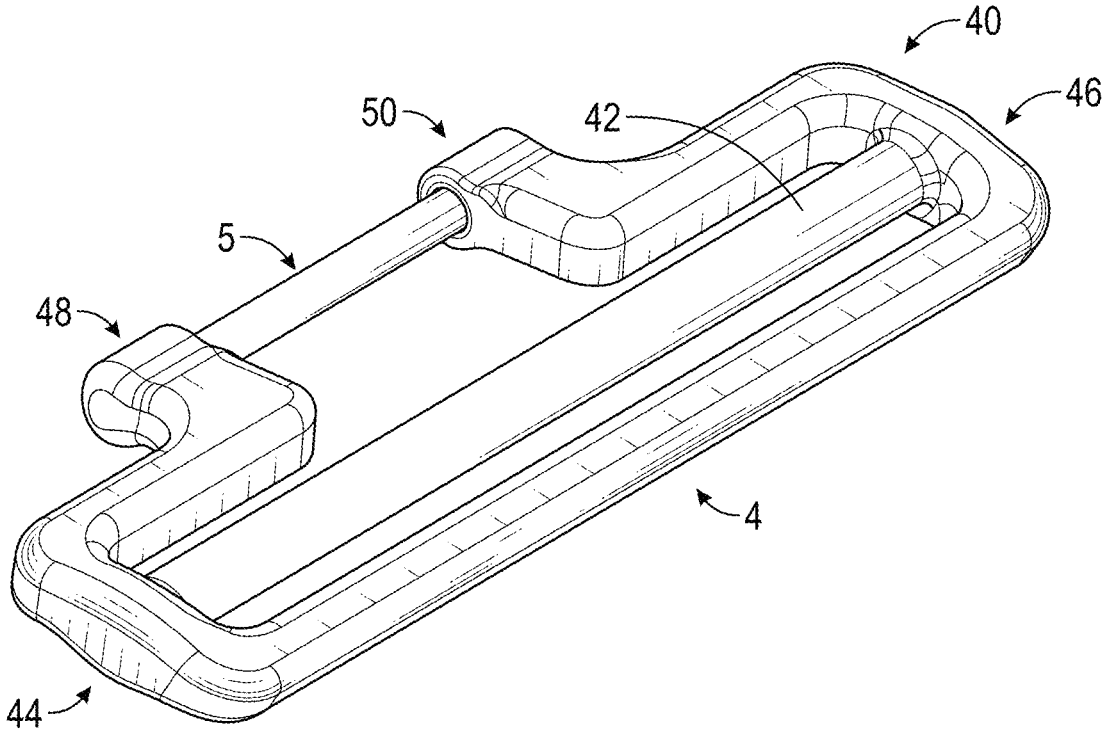
FIG. 2 illustrates an embodiment of a ladder buckle that can include one or more magnetic elements.

FIG. 2 illustrates a buckle 4, such as a ladder buckle in some cases. The buckle 4 includes a frame 40 and a crossbar 42 spanning two lateral segments 44, 46 of the frame. In some variants, a strap can wrap around the crossbar 42. One end of the frame 40 can include two spaced apart portions 48, 50 connected by a magnetic element 5 that can include magnetic, ferrous, or other materials as disclosed elsewhere herein. The magnetic element 5 can be a rod, bar, cylinder, pin, etc.

Figure 2A:
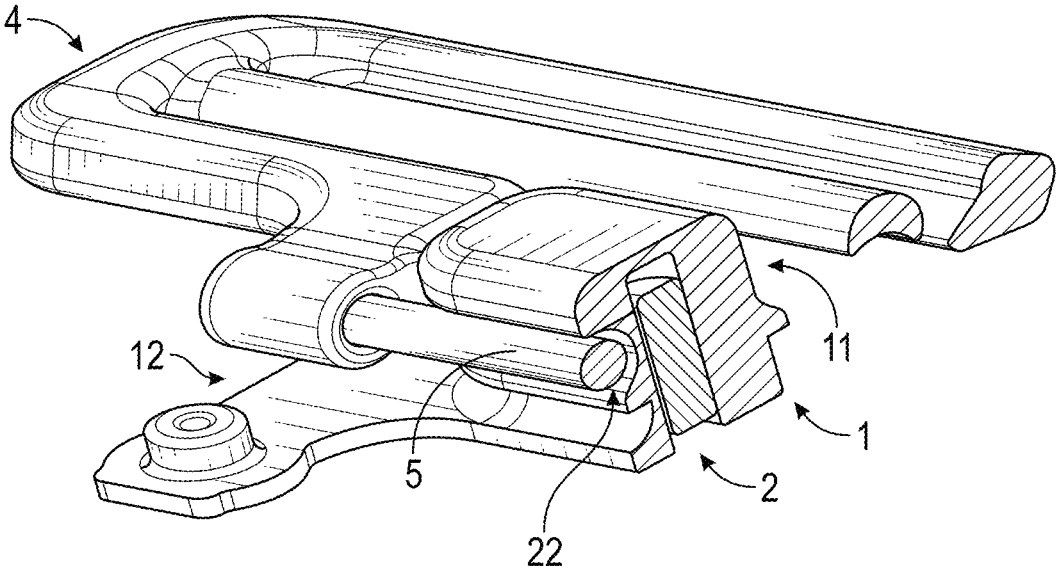
FIG. 2A illustrates a cross-section of the anchor and the buckle coupled together.

FIG. 2A illustrates a cross-section of the anchor 1 and the buckle 4 coupled together. When the anchor 1 and buckle 4 are positioned near each other, the magnetic elements (e.g., magnetic element 2 of the anchor 1 and magnetic element 5 of the buckle 4) attract each other as shown to position the magnetic element 5 in the structural feature 22. A structural feature 22 such as the groove of the anchor 1 as described herein can assist in maintaining the magnetic element 5 of the anchor 1 in place. The housing 11 can be configured to rotate fully or partially around the base 12 and vice versa. The anchor 1 and buckle 4 can, in some variants, be rotated relative to each other. This type of rotation can be advantageous to improve the fit of the system.

Figure 3A:
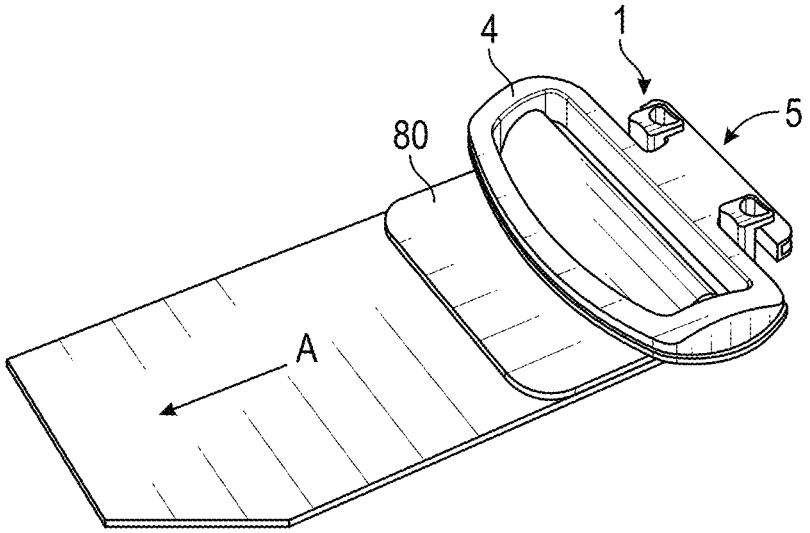
As illustrated in FIG. 3A, once the ladder buckle is reversibly captured on the anchor if an adjustable strap is present, it can be tensioned by pulling the strap in a particular direction.

As illustrated in FIG. 3A, once the ladder buckle 4 is reversibly captured on the anchor 1, if an adjustable strap 80 is present, it can be tensioned by pulling the strap 80 in a particular direction, such as the direction of arrow A.

Figure 3B:
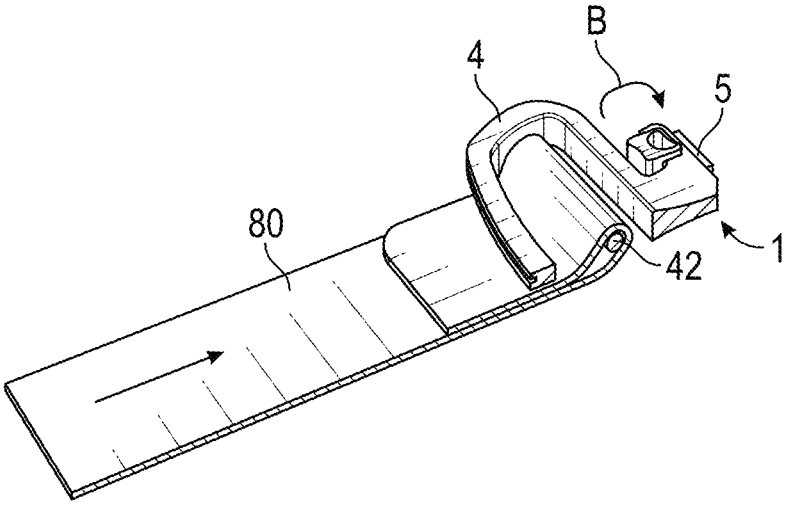
As illustrated in FIG. 3B, once the ladder buckle is captured on the anchor if an adjustable strap is present, it can be de-tensioned by rotating the buckle around the anchor.

As illustrated in FIG. 3B, once the ladder buckle 4 is captured on the anchor 1 if an adjustable strap 80 is present, it can be de-tensioned by rotating the buckle 4 in the direction of arrow B around the anchor 1 as illustrated (e.g., moving an end of the frame of the buckle 4 that is opposite the end of the frame comprising the magnetic element 5), where the axis/center of rotation is the magnetic element 5 rotating while coupled to the structural feature 22.

Figure 3C:
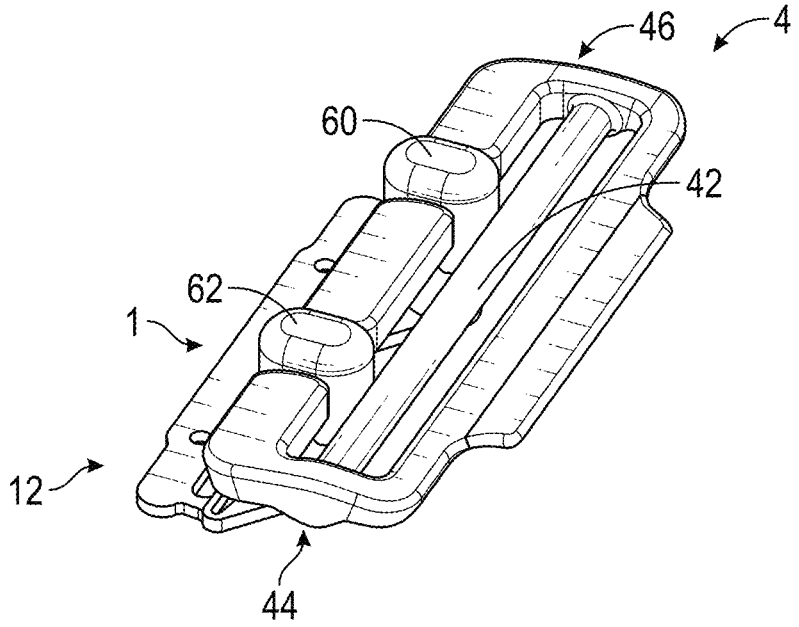
FIGS. 3C, 3D, and 3E schematically illustrate a ladder buckle that can rotate about an anchor.
Figure 3D:
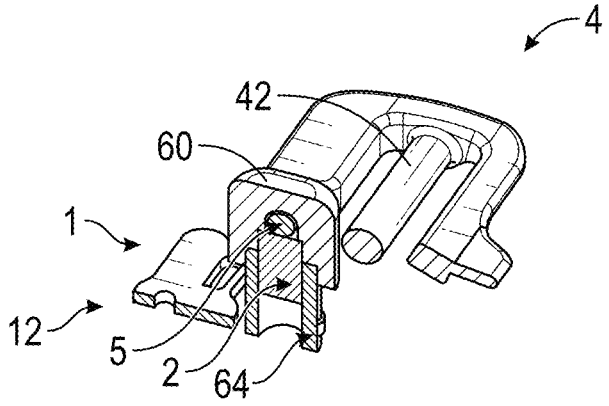
Figure 3E:
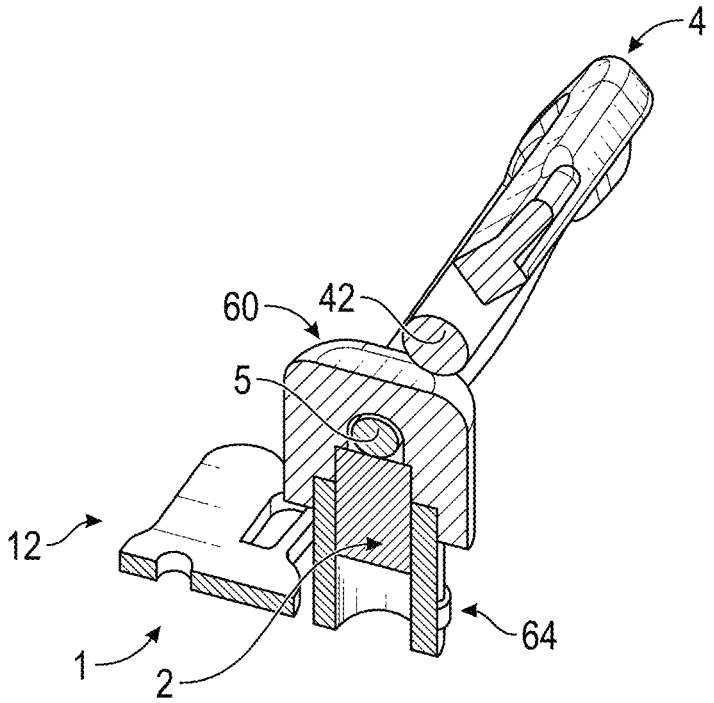
Figures 4A, 4B, 4C, 4D:
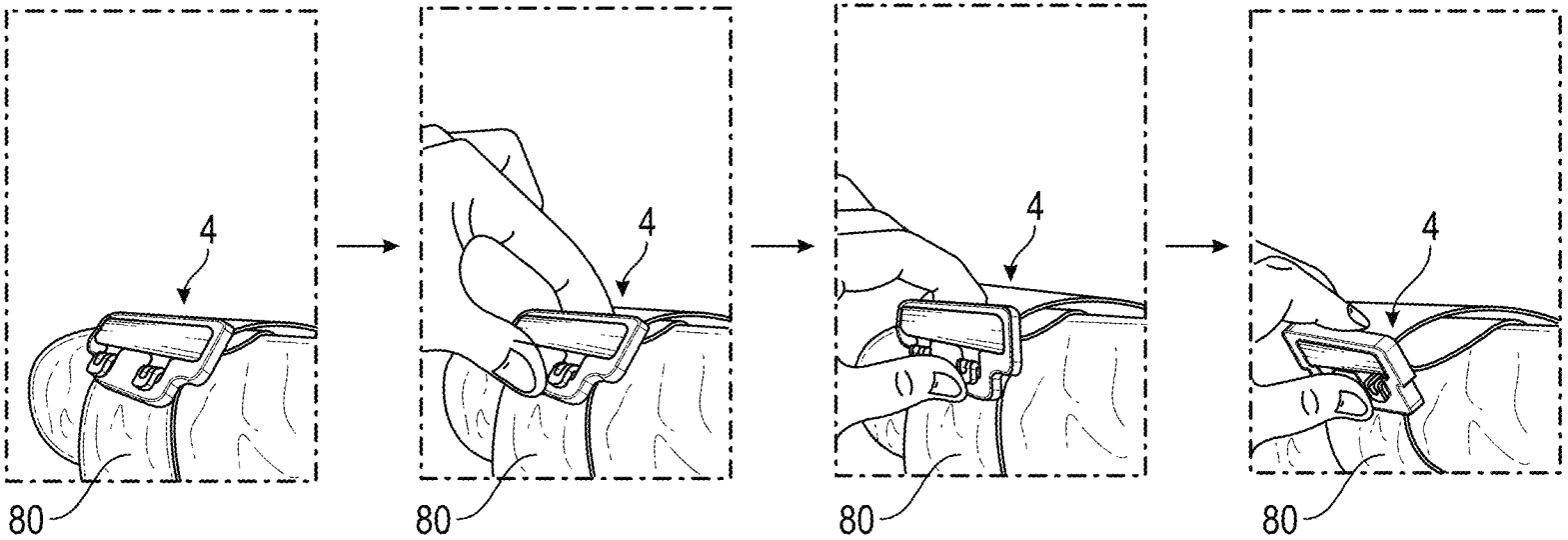
FIGS. 4A, 4B, 4C, and 4D schematically illustrate stepwise loosening of a strap with respect to an anchor-buckle system, according to some embodiments.

FIGS. 3C-3E schematically illustrate another buckle 4 and anchor 1 joined together, wherein the ladder buckle 4 can rotate about the anchor 1. FIG. 3C illustrates the buckle 4 connected to anchor 1. The buckle 4 can include caps 60, 62, which can also be referred to as tops, covers, etc. In some variants, the buckle 4 incorporates only one cap or more than two caps. FIG. 3D illustrates a partial cut-away view showing that the caps 60, 62 can respectively be disposed over protrusions 64, which can also be referred to as posts, vertical posts, columns, uprights, etc., of the anchor 1 to removably secure the buckle 4 to the anchor 1. The protrusions 64 can extend vertically away from the base 12 of the anchor 1. The protrusions 64 can respectively hold or otherwise support a magnetic element 2 that can attract the magnetic element 5 of the buckle 4. The magnetic element 5 can be coupled to the caps 60, 62, which can include extending through the caps 60, 62, such that the caps 60, 62 can be coupled to the protrusions 64 by the interface therebetween, the interface between the caps 60, 62 and the magnetic elements 2, and/or the attraction between the magnetic element 5 and the magnetic element(s) 2. The caps 60, 62, in some variants, can rotate relative to the magnetic element 5 to permit the anchor 4 to rotate about the magnetic element 5 with the caps 60, 62 secured on the protrusions 64. FIG. 3E illustrates the partial rotation of the buckle 4 with respect to the anchor 1. The buckle 4 and the anchor 1 can be decoupled by lifting the caps 60, 62 off of the protrusions 64, which can include overcoming the magnetic attraction between the magnetic element(s) 5 and magnetic element(s) 2.

FIGS. 4A-4D schematically illustrate stepwise loosening of a strap with respect to an anchor-buckle system, according to some embodiments. A user can grasp and rotate the buckle 4, as shown, to loosen the adjustable strap 80.

Figure 5:
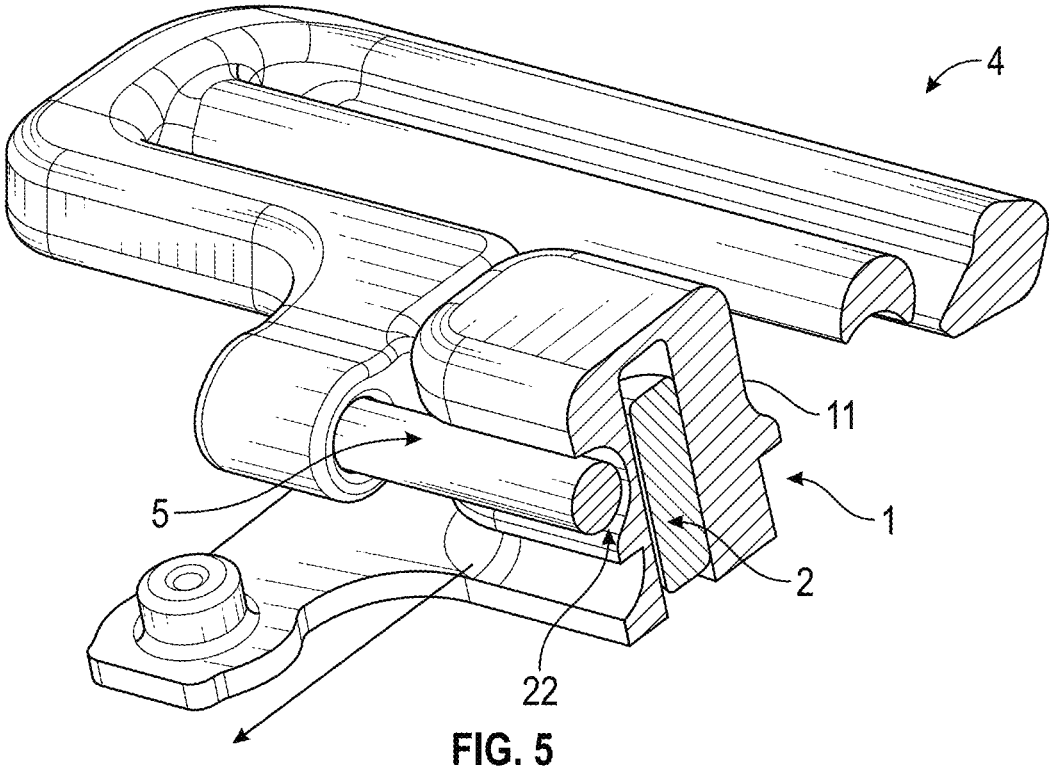
FIG. 5 illustrates the quick-release mechanism for the anchor-buckle system.

FIG. 5 illustrates the quick-release mechanism for the anchor-buckle system. To release or unlock the ladder buckle 4 from the anchor 1, the ladder buckle 4 can be simply pressed or moved away from the feature 22 of the housing 11 located on the anchor 1 as illustrated, thus disassociating the anchor 1 from the buckle 4, as the magnetic element 2 of the anchor 1 and the magnetic element 5 of the frame become farther apart from each other. In some embodiments, no other feature is restraining the buckle 4 from the anchor 1 other than the magnetic attraction of the complementary buckle and anchor magnetic elements. The buckle 4 can then be moved (e.g., raised) to remove the housing 11 from within the buckle 4.

Figure 6A:
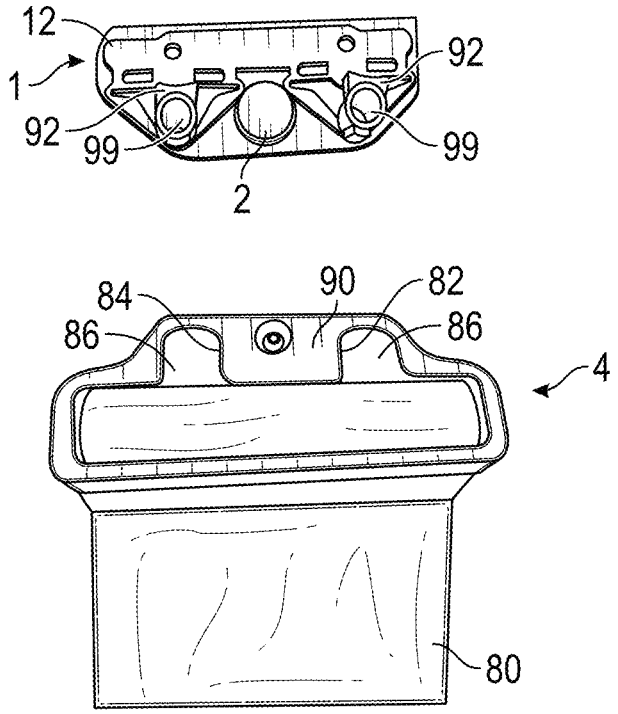
FIGS. 6A, 6B, 6C, and 6D illustrate views of quick-connect anchor-buckle systems.
Figure 6B:
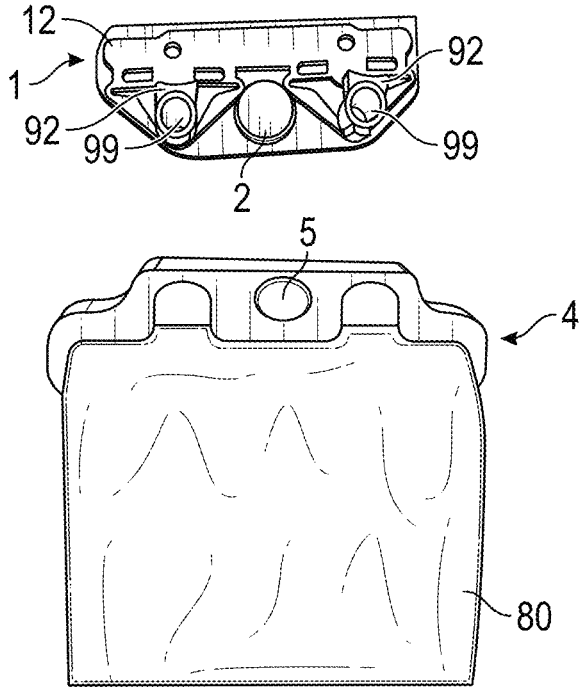
Figure 6C:
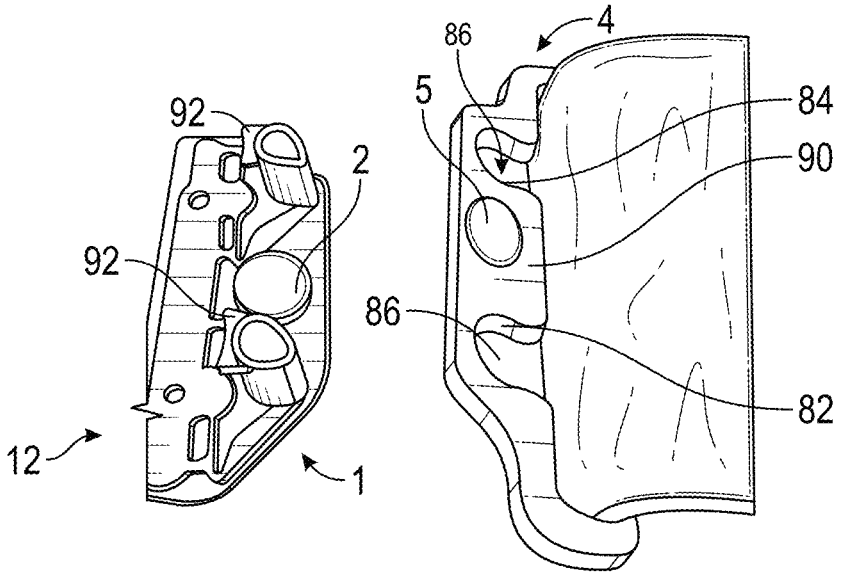
Figure 6D:
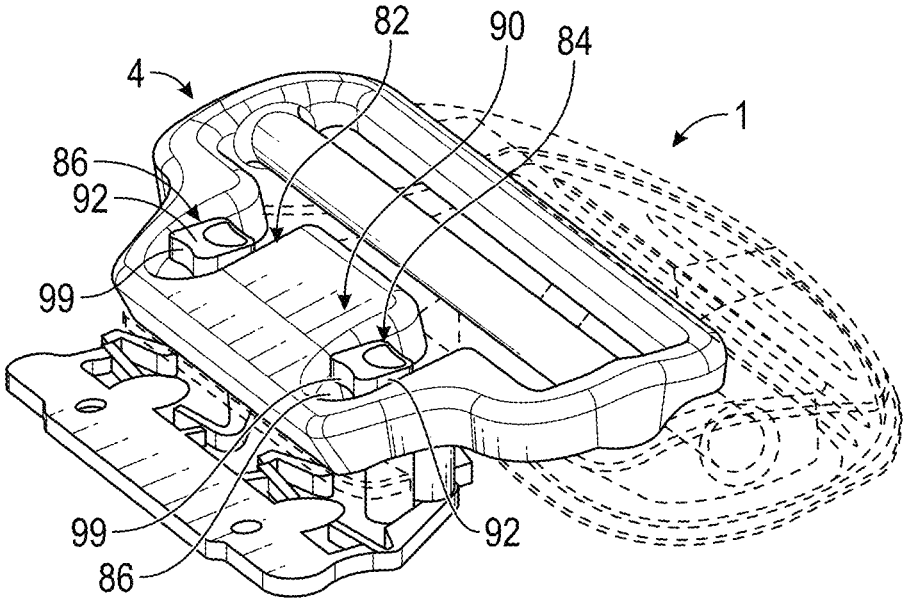

FIGS. 6A-6D illustrate views of another embodiment of quick-connect anchor-buckle systems. In this embodiment, the end of the buckle 4 can be configured to magnetically couple to the anchor 1. The end of the buckle 4 can include a continuous outer perimeter frame comprising the same material, and a magnetic element 5 attached to an inwardly-extending tab 90 of the buckle 4, which in turn can couple to a magnetic element 2 on the base 12 of the anchor 1. The lateral borders 82, 84 of the tab 90 can abut inlets 86 (e.g., incomplete apertures that can be U-shaped or other shapes in some cases) that can be arcuate as shown in some embodiments and rest against a plurality of respective spaced-apart struts 99 of the anchor 1, as shown in FIGS. 6C and 6D. In some cases, vertically-oriented members such as pins (not shown) can be installed within struts 99 for increased support. The inlets 86 can be positioned around the struts 99 such that the end of the buckle 4 is disposed under one or more flanges 92 that extends from the struts 99, as shown in FIG. 6D, to couple the anchor 1 to the buckle 4. The magnetic attraction between the magnetic element 2 on the anchor 1 and the magnetic element 5 on the buckle 4 can help to secure the anchor 1 and the buckle 4 together.

Figure 7A:
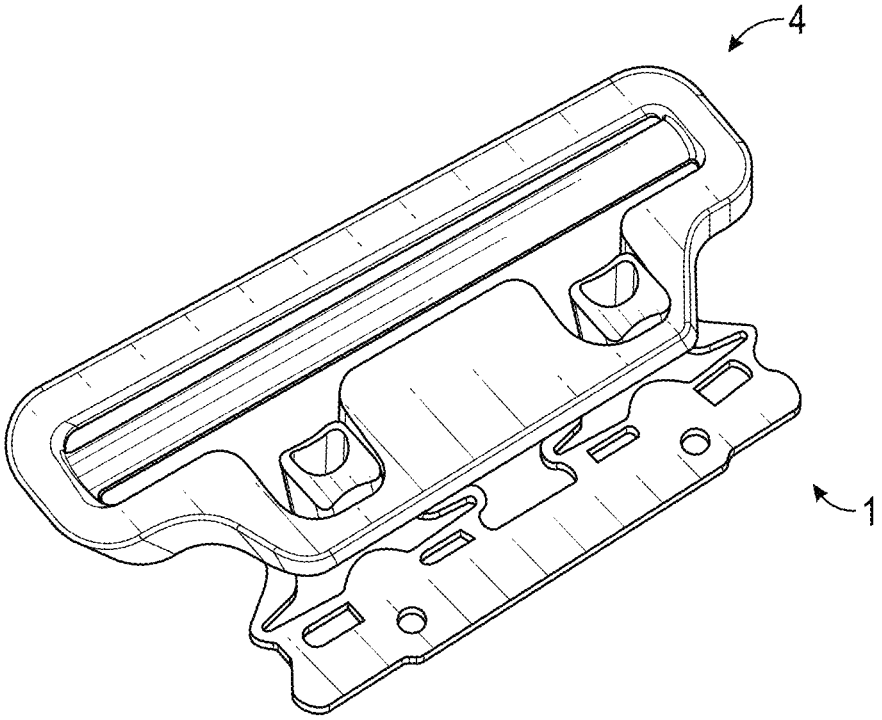
FIGS. 7A and 7B illustrate views of an anchor-buckle system that can be similar to that shown of FIGS. 6A-6D, with the buckle raised in FIG. 7B compared to FIG. 7A in order to tighten or loosen an associated strap, depending on the desired result.
Figure 7B:
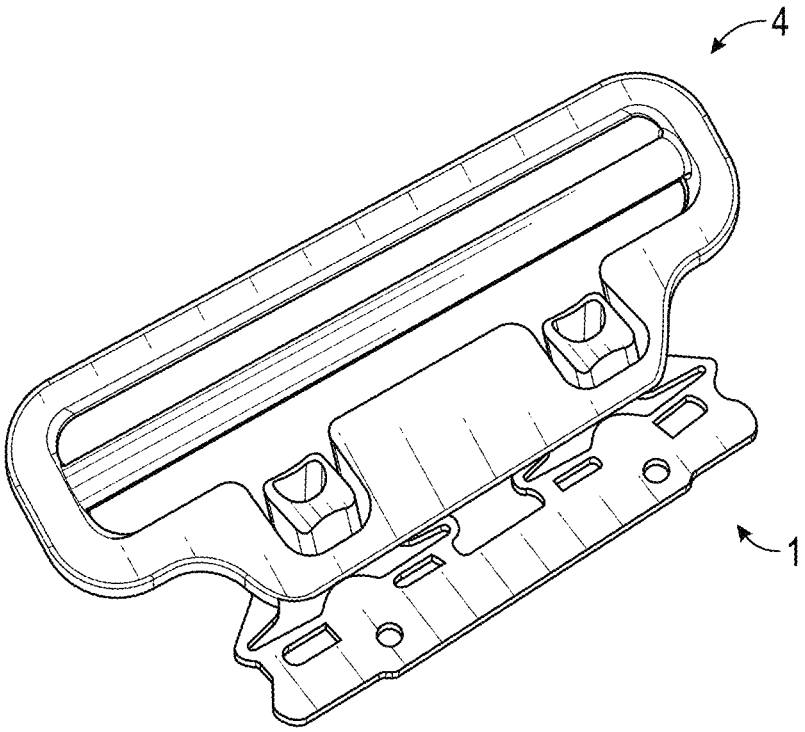

FIGS. 7A-7B illustrate views of an anchor-buckle system that can be similar to that shown of FIGS. 6A-6D, with the buckle raised in FIG. 7B compared to FIG. 7A in order to tighten or loosen an associated strap, depending on the desired result.

Figure 8:
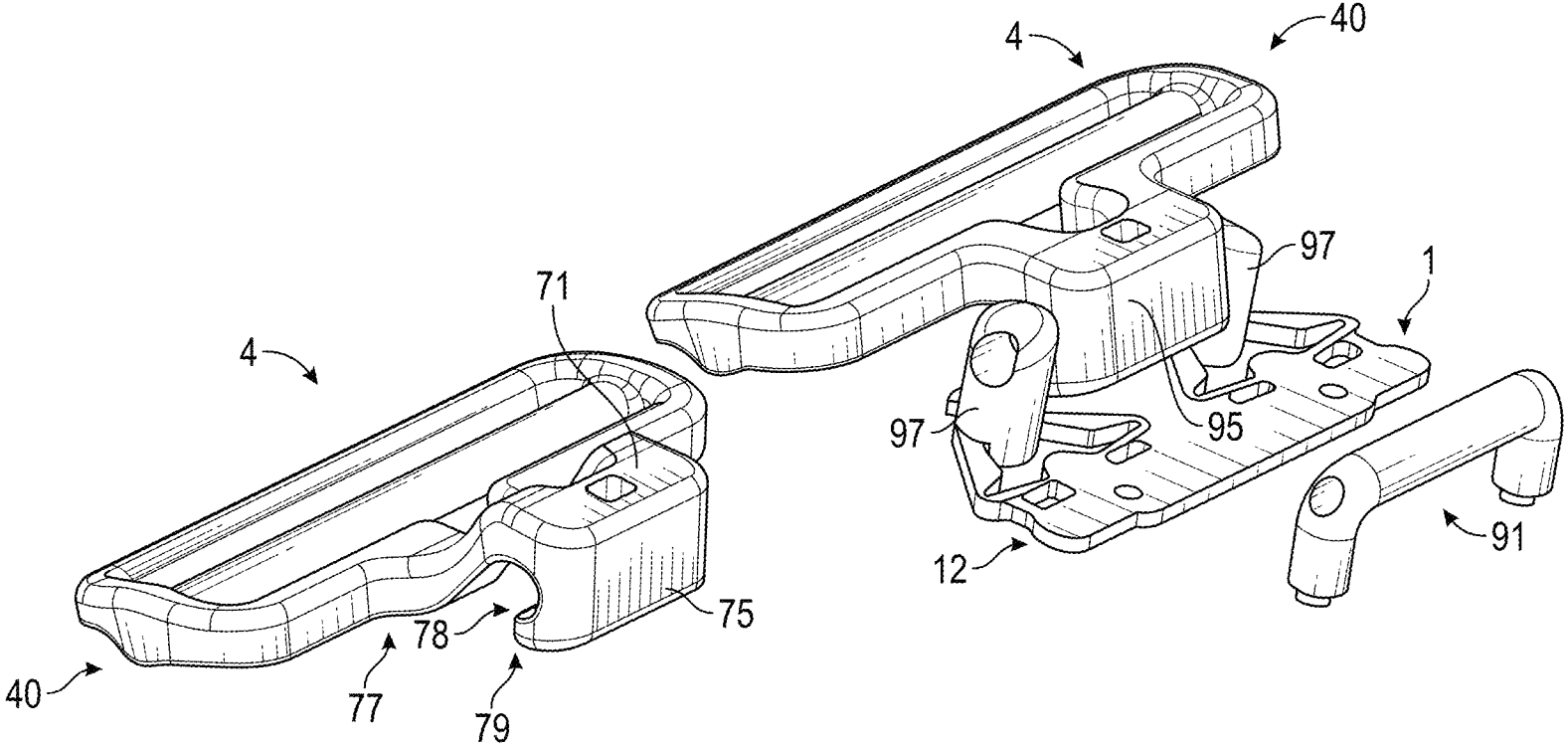
FIG. 8 illustrates views of another embodiment of an anchor-buckle system including a buckle comprising a frame and a shoulder portion extending away from the end of the frame and also including a ledge extending back toward the frame.

FIG. 8 illustrates views of another embodiment of an anchor-buckle system including a buckle 4 comprising a frame 40 and a shoulder portion 71 extending away from the end of the frame 40 and also including a ledge 79 extending back toward the frame 4. The ledge 79 can include one or more magnetic elements 5 as previously described, and interface with a corresponding magnetic element (not shown) of an anchor 1. The ledge 79 can further define a channel 78 between a sidewall 77 of the ledge 79 and an end wall 75 of the frame 40, that can serve as a pivot to allow for tightening or loosening of an associated strap (not shown). Also illustrated in an exploded view is locking element 91 configured to lock one or more components of the system in place to inhibit removal once the system is in place, such as the anchor 1 for example. The locking element 91 can take the form of a generally U-shaped bar in some cases. In some embodiments, in addition to, or in lieu of locking element 91, a cross-pin 95 can be installed through generally vertical posts 97 to provide a pivot structure for the buckle. The posts 97 can be molded together, and in some cases integrally formed with the base 12 of the anchor 1. The cross-pin 95 can be made of, for example, a metal, such as a ferrous material. The cross-pin 95 can be a solid structure in some cases. Both the locking element 91 and/or cross-pin 95 elements can employ geometries such that the buckle, e.g., shoulder portion 71 can be (1) rotated down, then (2) translated up at a slight angle until the u-post is cleared, then the buckle can be "released". This motion of release can advantageously provide extra retention to reduce accidental disconnections. In some variants, the cross-pin 95 and/or locking element 91 can have magnetic properties and/or be ferrous allowing for attraction with a magnetic element 5 in the shoulder portion 71, which can help retain the cross-pin 95 and/or locking element 91 in the channel 78.

Figure 9:
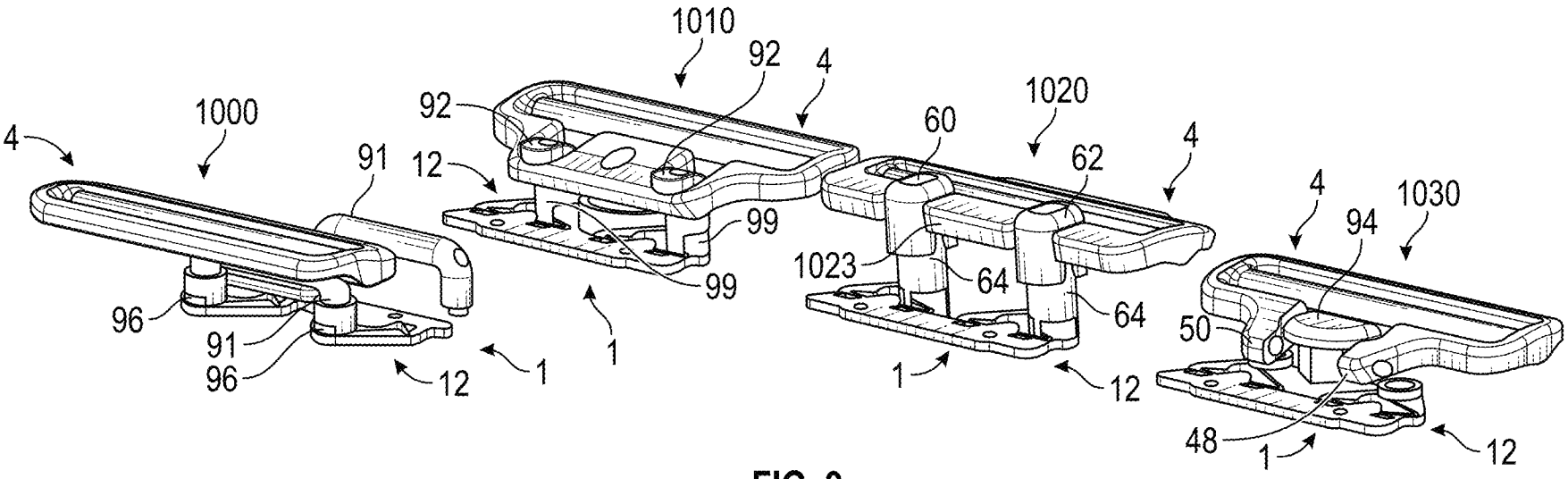
FIG. 9 illustrates anchor-buckle systems.

FIG. 9 illustrates additional embodiments of anchor-buckle systems. System 1000 can include features as disclosed, for example, in connection with the anchor-buckle system of FIG. 8. The locking element 91 is shown in place in the assembled system, with ends of the locking element 91, which can be a u-shaped structure, attached to complementary ports 96 on the anchor 1. The locking element 91 can be made of any appropriate material, such as a plastic material in some cases. In some variants, the locking element 91 can be made of a material with magnetic properties which can be attracted to a corresponding material with magnetic properties in the buckle 4. In some variants, the locking element 91 can be disposed within a channel of the buckle 4 when the anchor 1 and the buckle 4 are coupled together. System 1010 can include features as disclosed, for example, in connection with the anchor-buckle system of FIGS. 6D, 7A, and 7B. System 1010 can differ from system 1000 in that, for example, (1) release motion is a translation backwards away from the vertical posts or struts 99, such as only backwards away from the vertical posts, and (2) the dual vertical pins provide improved direct transfer of force to the lower structure, as that is centrally located and can be allowed to pivot slightly. The vertical posts or struts 99 can include flanges 92 (e.g., lips, rim, tabs, etc.), which can help to retain the buckle 4 coupled to the anchor 1. System 1020 can include features as disclosed, for example, in connection with the anchor-buckle system of FIGS. 3C-3E. System 1020 can include one, two, or more magnetic elements in the top removable buckle 4. It can advantageously have a motion of install/removal that is vertically oriented for easier assembly/disassembly. As described in reference to FIGS. 3C-3E, the buckle 4 can include caps 60, 62. The caps 60, 62 can be disposed over the protrusions or posts 64 to couple the buckle 4 to the anchor 1. Magnetic elements can be disposed in the caps 60, 62 and magnet(s) or ferrous material(s) can be disposed in the protrusions or posts 64 to help retain the caps 60, 62 on the protrusions or posts 64. This system 1020 can also include a hinge 1023 built in between the caps 60, 62 on the buckle 4, and/or the "ladder" portion of the buckle 4 to allow for multi-axis adjustment. System 1030 can include features as disclosed, for example, in connection with FIG. 5 above. The anchor 1 can include an over-hand portion, hook, catch, clip, or clasp 94 that can retain a horizontally oriented pin (not shown), such as the magnetic element 5, that spans between two spaced apart portions 48, 50. Similar to FIG. 5, to decouple the buckle 4 from the anchor 1, the buckle 4 can be translated away, e.g., "backwards," away from the catch 94 such that the horizontally oriented pin, e.g., magnetic element 5, is moved out from under the catch 94 and then translated vertically relative to the anchor 1. Magnetic or ferrous material can be disposed in the catch 94 and a magnetic or ferrous material can be disposed in the horizontal oriented pin (not shown). In some variants, the catch 94 can include a channel or groove to receive the horizontal oriented pin. One or more ferrous pins (not shown) can be present in horizontal orientations across a portion of the anchor, or vertical orientations in other embodiments.

Various other modifications, adaptations, and alternative designs are of course possible in light of the above teachings. Therefore, it should be understood at this time that within the scope of the appended claims the invention may be practiced otherwise than as specifically described herein. It is contemplated that various combinations or subcombinations of the specific features and aspects of the embodiments disclosed above may be made and still fall within one or more of the inventions. Further, the disclosure herein of any particular feature, aspect, method, property, characteristic, quality, attribute, element, or the like in connection with an embodiment can be used in all other embodiments set forth herein. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above. Moreover, while the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication. For example, actions such as "tightening a strap with respect to a buckle" includes "instructing the tightening of a strap with respect to the buckle." The ranges disclosed herein also encompass any and all overlap, sub-ranges, and combinations thereof. Language such as "up to," "at least," "greater than," "less than," "between," and the like includes the number recited. Numbers preceded by a term such as "approximately", "about", and "substantially" as used herein include the recited numbers (e.g., about 10%=10%), and also represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount.

What is claimed is:

1. A quick connect system, the system comprising:

an anchor comprising a base and a housing extending vertically from the base, the base configured to be coupled to a device, and the housing comprising an open channel and a first magnetic element; and a buckle comprising a second magnetic element and a frame with two spaced-apart portions, the second magnetic element spanning between the two spaced-apart portions and configured to be positioned in the open channel of the housing such that the two spaced-apart portions of the frame are disposed on opposing lateral sides of the housing;

wherein the first magnetic element is configured to retain the second magnetic element in the open channel by way of magnetic attraction force; and wherein the second magnetic element is configured to extend beyond lateral ends of the open channel.

2. The system of claim 1, further comprising a crossbar spanning an interior portion of the frame.

3. The system of claim 2, wherein the crossbar is configured to be coupled to a strap.

4. The system of claim 2, wherein a central longitudinal axis of the crossbar is parallel to a central longitudinal axis of the second magnetic element.

5. The system of claim 2, further comprising a strap configured to be coupled to the crossbar.

6. The system of claim 5, wherein the strap is configured to be wrapped around the crossbar such that pulling the strap in a direction tensions the strap.

7. The system of claim 1, wherein the second magnetic element comprises a bar.

8. The system of claim 1, wherein the open channel comprises a shape that is complementary to a shape of the second magnetic element.

9. The system of claim 1, wherein the first magnetic element is disposed inside of the housing.

10. The system of claim 1, wherein a wall of the housing is configured to be disposed between the first magnetic element and the second magnetic element.

11. The system of claim 1, wherein the device comprises a compression device configured to be wrapped around a body part of a patient.

12. The system of claim 1, wherein the open channel is spaced away from the base.

13. A quick connect system, the system comprising:

an anchor comprising a base configured to be coupled to a device, an open channel, and a first magnetic element; and a buckle comprising a second magnetic element and a frame with two spaced-apart portions separated by a gap, the second magnetic element comprising a bar spanning the gap between the two spaced-apart portions and configured to be positioned in the open channel such that the two spaced-apart portions of the frame are disposed on opposing lateral sides of the anchor;

wherein the first magnetic element is configured to retain the second magnetic element in the open channel by way of magnetic attraction force; and wherein the second magnetic element is configured to extend beyond lateral ends of the open channel.

14. The system of claim 13, wherein the anchor comprises a housing.

15. The system of claim 14, wherein the housing extends vertically away from the base to space the open channel away from the base.

16. The system of claim 13, wherein the first magnetic element is disposed inside the anchor such that the first magnetic element and the second magnetic element do not touch.

17. The system of claim 13, further comprising a crossbar spanning an interior portion of the frame.

18. The system of claim 17, wherein a central longitudinal axis of the crossbar is parallel to a central longitudinal axis of the second magnetic element.

19. The system of claim 18, wherein the second magnetic element comprises a cylindrical shape.

* * * * *